United States Patent [19]

Klein et al.

[11] 4,146,077

[45] Mar. 27, 1979

[54] METHODS AND APPARATUS FOR MAKING CAST HOLLOWS

[75] Inventors: H. Joseph Klein, Kokomo, Ind.; Wilfredo V. Venal, Pampa, Tex.

[73] Assignee: Cabot Corporation, Kokomo, Ind.

[21] Appl. No.: 844,591

[22] Filed: Oct. 25, 1977

[51] Int. Cl.[2] ..... B22D 27/02

[52] U.S. Cl. ..... 164/4; 164/154; 164/52; 164/252

[58] Field of Search ..... 164/52, 252, 4, 154; 13/9 ES; 75/10 C

[56] References Cited

U.S. PATENT DOCUMENTS

| | | | |
|---|---|---|---|
| 3,456,715 | 7/1969 | Freedman et al. | 164/4 |
| 3,610,320 | 10/1971 | Medovar | 164/252 |
| 3,643,724 | 2/1972 | Lee | 164/4 |
| 3,721,286 | 3/1973 | Paton et al. | 164/52 |
| 3,768,541 | 10/1973 | Paton et al. | 164/52 |
| 3,834,443 | 9/1974 | Ujiie | 164/252 |
| 3,834,447 | 9/1974 | Luchok et al. | 164/252 |
| 3,942,105 | 3/1976 | Bondarenko et al. | 164/154 |
| 3,971,430 | 7/1976 | Paton et al. | 164/252 |
| 3,990,500 | 11/1976 | Paton et al. | 164/252 |
| 3,999,595 | 12/1976 | Medovar et al. | 164/252 |
| 4,000,361 | 12/1976 | Bondarenko et al. | 164/252 |

*Primary Examiner*—Richard B. Lazarus
*Assistant Examiner*—K. Y. Lin
*Attorney, Agent, or Firm*—Jack Schuman; Joseph J. Phillips

[57] ABSTRACT

A method and apparatus are provided for forming hollow superalloy ingots by melting a molten superalloy electrode by ESR techniques into a molten slag held in a generally cylindrical mold having an axially movable mandrel until the molten metal is adjacent the level of but not over the top of the mandrel, cooling the metal sufficiently to form supporting external and internal walls, moving the mandrel vertically relative to the cooled metal, continuing to melt metal into said slag while moving the mandrel at a rate such that the molten metal remains at a substantially constant level adjacent the top of the mandrel and cooling the formed hollow ingot.

12 Claims, 7 Drawing Figures

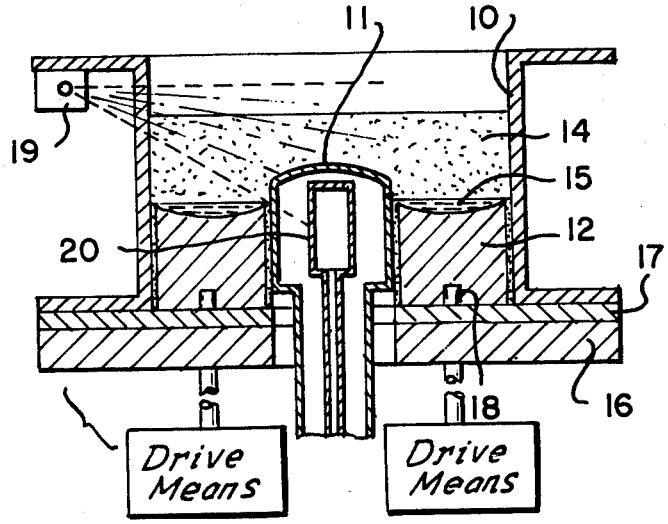

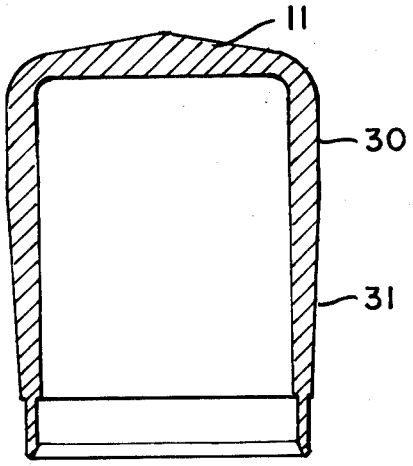

METHODS AND APPARATUS FOR MAKING CAST HOLLOWS

This invention relates to methods and apparatus for making cast hollows which may be used for superalloy rings, gun barrels, etc., and particularly to methods and apparatus using a molten metal level control system and cooled tapered mandrel for forming the cast hollow.

The development of sophisticated alloys and their adaptation to rotating components has led to the development of higher performance jet engines, turbine parts and a variety of other components. Many of these parts are hollow or ring shaped. This had led to a significant increase in material costs because of the higher cost of the alloy compositions involved compounded by poor processing yields normally associated with such compositions and the critical sensitivity of the compositions to in-process control. Additionally material utilization from ingot to final component, particularly in jet or turbine engine parts, has been significantly reduced as a result of the complex designs employed. This is true for many other types of metal hollows such as gun barrels. The ultimate object of this invention is to reduce the cost of many of these parts which are hollow or ring-like in form by providing a method and apparatus for castig ring-like shapes of sophisticated or so called "superalloys" and other alloys. The invention makes possible significant cost savings in the production of such parts.

This is not the first attempt to provide a hollow casting of metal. For example, U.S. Pat. Nos. 3,687,188; 3,610,370; 3,683,997; 3,721,286; 3,987,843; 3,990,499; 3,990,500 and 3,999,595 all provide an apparatus for melting hollow ingots by electroslag remelting. The apparatus and process there described are not completely satisfactory for the production of hollow castings of superallys. Such superalloys are very sensitive to electrode change, to electrode position, to metal level and mandrel shape and control. The use of a plurality of small electrodes around the ingot or casting as illustrated in several of the prior art patents requires changing electrodes during melting. We have found that for example, Haynes alloy No. 718, such changes produce clearly discernible changes in the morphology of the primary carbides and in the size and distribution of Laves phases. The gross segregation which appears is such that it is impossible to remove it by annealing or thermo-mechanical processing. In addition, the superalloy rings are highly sensitive to off center electrodes which produce run outs along the periphery of the crucible. Finally, the superalloys are highly sensitive to mandrel shape and to the level of metal with respect to the mandrel head and the mandrel and metal level described in the prior art will not produce satisfactory castings. Another proposal of the prior art has been to use a hollow electrode with a disposable mandrel. This practice is subject to very high costs of electrode and mandrel and is useful for production of short hollows only.

We have developed a process which reduces the cost of producing hollows or rings and which is practical for production of commercial hollows which no system of the prior art can do.

We provide a process which comprises the steps of melting a superalloy electrode by ESR techniques into a molten slag held in a movable cylindrical mold having an axially movable mandrel until the molten metal is at a preselected level on the upper portion of the mandrel, cooling the metal sufficiently to form supporting internal and external walls, moving the mold and mandrel vertically relative to the cold metal, continuing to melt metal into said slag while moving the mold and mandrel at a rate such that the molten metal remains at a substantially constant level at the top of the mandrel and cooling the formed hollow ingot. Preferably the mold is closed at the bottom by a bottom plate having a plurality of projections extending vertically between the mold and mandrel. The mandrel is preferably cylindrical in shape at the top over a vertical distance sufficient to provide cooling of the internal surface of the metal to support the molten metal in the interior and is then frusto conical in shape, narrowing downwardly from the cylindrical top. Level measuring means are preferably provided for measuring the level of molten metal with respect to the top of the mandrel. The level measuring means may be nuclear, pressure or by direct measurement.

In the foregoing general description we have set out certain objects, purposes and advantages of our invention. Other objects, purposes and advantages of the invention will be apparent from a consideration of the following description and the accompanying drawings in which.

Figure 1:
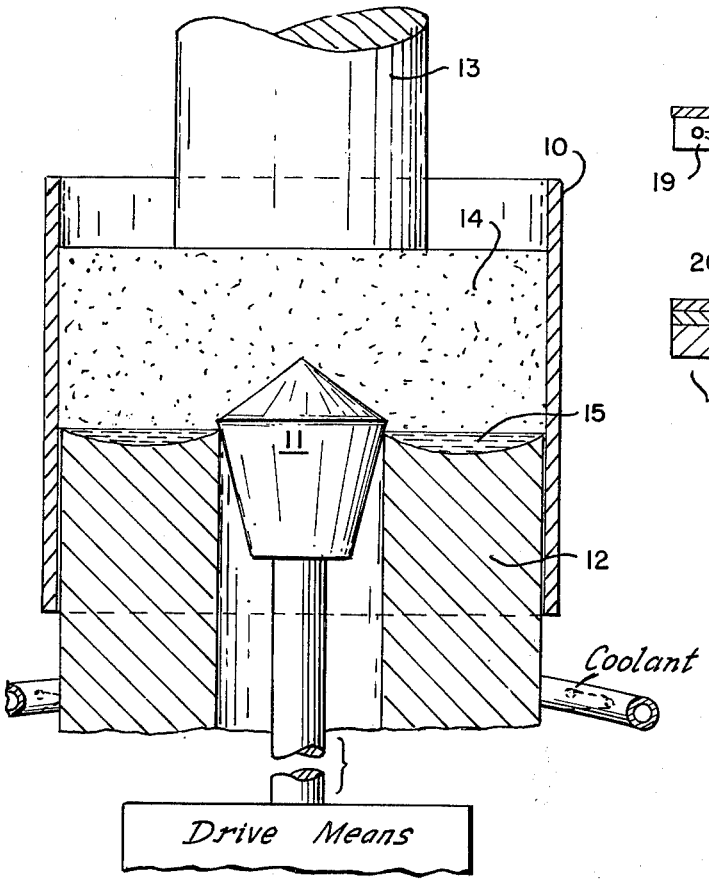
FIG. 1 is a general schematic section of an apparatus according to our invention.

Referring to the drawings we have illustrated a cylindrical movable mold 10 and an axial separately movable mandrel 11 adapted to form a hollow ingot or casting 12 by melting a large solid electrode 13 of superalloy composition in a slag 14 to form an annular pool of molten metal 15 on the top of the solidifying hollow ingot. The casting of the ingot is started with the mold 10 and mandrel 11 in place on a copper stool 16 carrying a steel base plate 17 with vertical studs 18 projecting vertically upwardly intermediate the mandrel 11 and mold 10. In order to maintain the desired level of metal between the mold 10 and mandrel 11 a radiation source e.g. a 1 Curie Ce 137 source 19 is fixed to mold 10 and a detector 20 is fixed within mandrel 11. Variations in the radiation reaching detector 20 cause the drive for the mandrel or mold or both (not shown) to move them relative to one another so as to maintain the selected level of metal between the mold and mandrel. This is particularly critical as respects the mandrel, for if the mandrel moves too slowly and metal goes over its top, sticking is likely to occur, whereas if it moves too fast and the metal level falls with respect to it then it is likely to cause either a run out or sticking of the metal on the lower end of the mandrel.

Preferably the mandrel is provided with straight cylindrical sides 30 at the top of the sidewall with a slight conical downward and inward taper 31 on the bottom portion of the sidewall. The length of the straight cylindrical sides 30 may vary depending upon the metal being poured. It is essential that this distance be sufficiently long so that the sidewall of the metal be solidified sufficiently to support the molten metal within and yet not so long that excessive frictional forces may build up causing the solidified wall to rupture. We have found that steels such as 4330 and superalloys such as Hastelloy® alloys X and C-276, which superalloys are, respectively, alloys in wide current usage by gas turbine engine manufacturers and chemical processors the length of the cylindrical portion is preferably about 3½ inches and the taper portion is about 6½ inches, with a 1.5° taper, on a 10 inch diameter mandrel.

®Hastelloy is a registered Trademark of Cabot Corporation.

Figure 4:
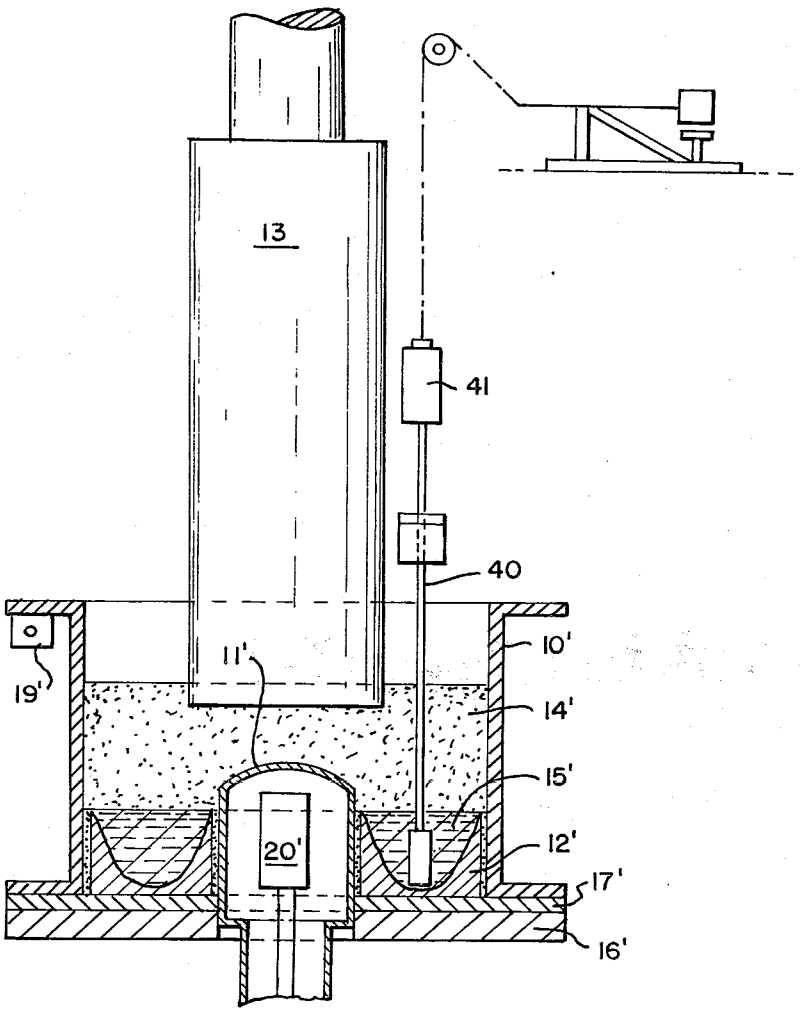
FIG. 4 is a schematic section through a second embodiment of apparatus according to our invention.

In FIG. 4 we have illustrated an apparatus according to our invention using a mechanical level detector for measuring the molten metal level. In this apparatus those parts which are the same as in FIG. 2 bear like numerals with a prime suffix. In this embodiment a rod 40 made of Hastelloy® alloy X is dipped into the molten metal pool 15' and by comparing the reading on a dip stick linear measure scale 41 to a zero reading taken prior to start up, one can determine the metal level height.

Figure 7:
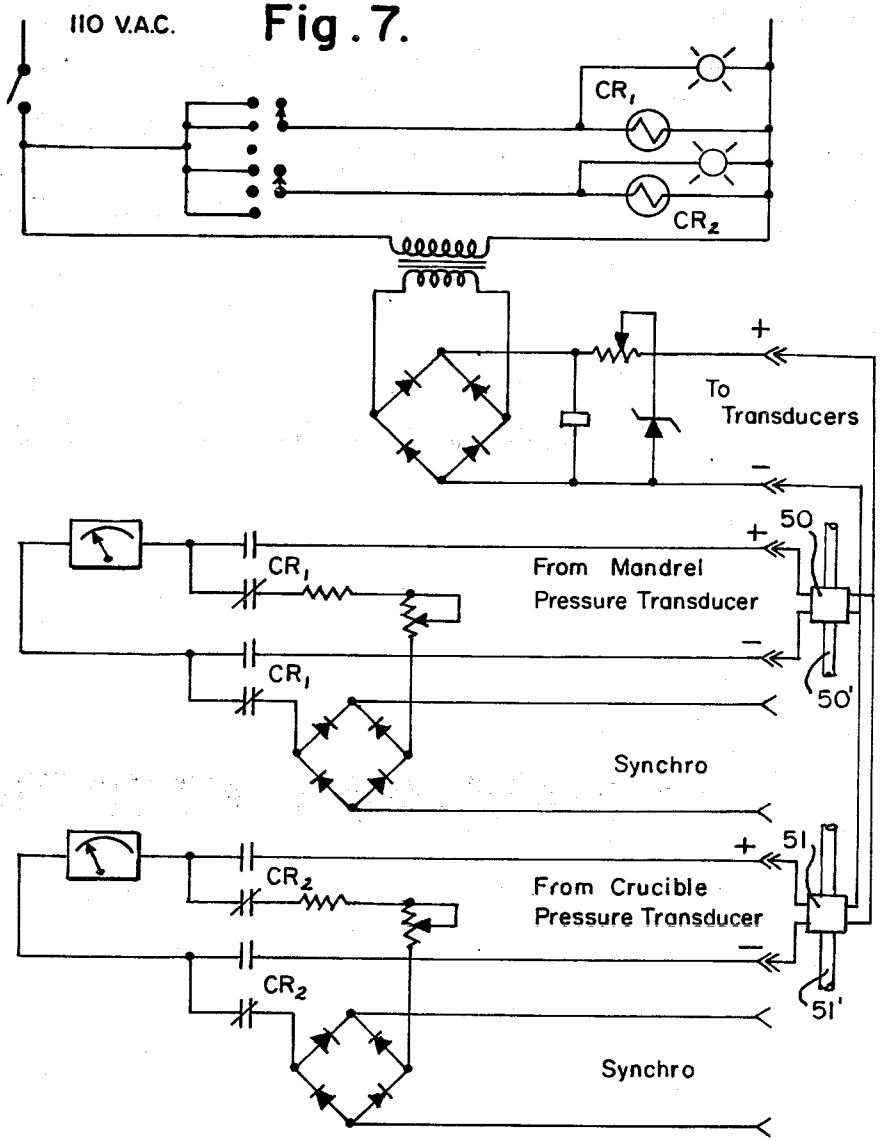
FIG. 7 is a schematic circuit diagram of mandrel and crucible pressure transducers for controlling metal level in a third embodiment of our invention.

In FIG. 7 we have illustrated a circuit for determining molten metal height or the mandrel as a function of the pressure. In this apparatus a pressure transducer 50 is installed in the hydraulic drive circuit 50' to the mandrel and pressure transducer 51 is installed in the hydraulic drive circuit 51' for the mold and the pressure applied to each is recorded from the time pressure is applied. The pressure in each drive circuit indicates the forces being applied to each of the mold and the mandrel and thus the level of molten metal. It is, of course, essential to calibrate this system with a nuclear system or the like.

In operation the practice of our invention will be best understood by the following example.

Figure 2:
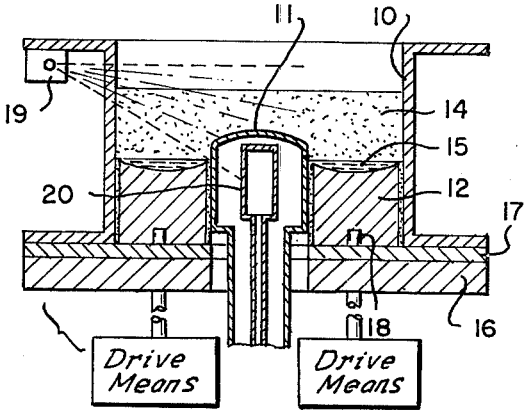
FIG. 2 is a schematic section through a presently preferred embodiment of apparatus of our invention.
Figure 3:
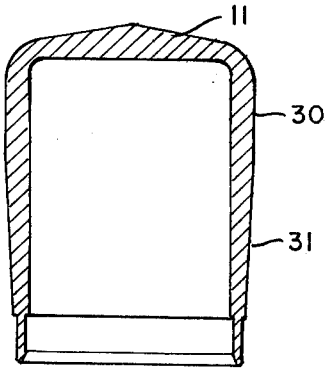
FIG. 3 is a section through a preferred mandrel head for use in our invention.
Figure 5:
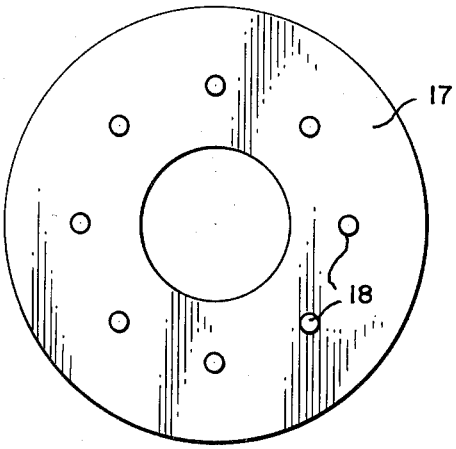
FIG. 5 is a top plan view of a base plate as used in our invention.
Figure 6:
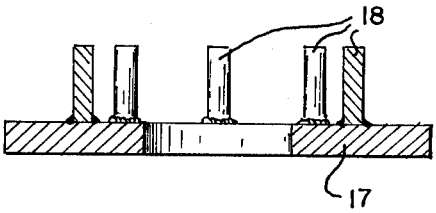
FIG. 6 is a section of the line VI—VI of FIG. 5.

An assembly as illustrated in FIG. 2 having a copper crucible 10 twenty (20") inches high and having an internal diameter of twenty-one (21") inches was placed on a steel base plate 17 having eight 13/4" diameter pins 18 2½" long extending upwardly between crucible 10 and mandrel 11. The mandrel was made of copper having a top diameter of ten (10") inches which extended downwardly from the top for a distance of 3½" in cylindrical form and then tapered inwardly at an angle of 1.5) for a distance of 6 3/4". The mandrel had an internal diameter of 8 3/8", means for water cooling and an axial detector 20 for picking up radiation from source 19 attached to the mold 10. The mandrel 11 was lowered until only 4' extended above the base plate 17. A seal of Kaowool was placed around the joint between the stool and mandrel. A 13' mandrel electrode of Haynes® alloy No. 718 which was 66" long and weighed 2,400 pounds was positioned vertically axially in the mold with its bottom end about 4" above the top of the copper mandrel and its top end attached in a Consarc Coaxial furnace. A molten slag of the composition 70F/15/10/5 was poured by means of a ceramic lined slag funnel into the mold around the mandrel to a level above the bottom of the electrode and the furnace was started. Power was adjusted to 1100 kw and between 1½" and 2" of metal were melted around the mandrel at which point the mandrel drive was started. The relative metal height was read from the nuclear level detection meter and a previously prepared calibration chart. When 10" of ingot was built up in the mold the crucible drive was engaged. The metal level relative to the mandrel is maintained at a specific height on the mandrel by adjusting the mandrel drive to correspond to the nuclear level readings. When the ingot was completely melted, the crucible drive was stopped but the mandrel drive continued until the mandrel was driven out of the ingot and slag. The resulting ingot was 21" O.D. × 10" I.D. × 30" long and weighed 2,400 pounds.

®Registered Trademark of Cabot Corporation.

While we have described our process and practice using a moving mold, the same practice could be followed using a static mold of sufficient length to hold the metal ring and a moving mandrel as here described.

Certain preferred practices and embodiments of this invention have been set out in the foregoing specification, however, it will be understood that this invention may be otherwise embodied within the scope of the following claims.

We claim:

1. The method of forming hollow metal articles comprising the steps of:

a. melting a metal electrode by ESR techniques into a molten slag held in a generally cylindrical mold having an axially movable mandrel having an upper cylindrical portion with straight cylindrical sides at the top of sufficient length to solidify the inner wall of metal enough to support molten metal in the interior against break out when unsupported by the mandrel and a bottom tapered frusto conical portion tapered at an angle sufficient to provide support to the cooling internal wall of the ingot while following the reduction in diameter of the hollow metal article during cooling until the molten metal is at a preselected level on the upper portion of the mandrel;

b. cooling the metal sufficiently to form supporting external and internal walls;

c. moving the mandrel vertically relative to the cooled metal;

d. continuing to melt metal into said slag while moving the mandrel at a rate such that the molten metal remains at a substantially constant level adjacent the top of the mandrel; and e. cooling the formed hollow article.

2. The method as claimed in claim 1 wherein the mold is a movable mold and said mold is moved independently of and coaxially with the mandrel as the metal solidifies therein.

3. The method as claimed in claim 1 including the steps of measuring the level of molten metal and controlling the movement of the mandrel to maintain the top of the molten metal at a substantially constant level adjacent the top of the mandrel.

4. The method as claimed in claim 1 wherein the mold is closed at the bottom by an annular starter plate surrounding the mandrel and having a plurality of spaced vertical projections between the mold and mandrel.

5. An apparatus for melting hollow metal articles by electroslag remelting of a single consumable metal electrode comprising a generally cylindrical mold, a bottom plate closing said mold at least during initial start of remelting, an axial hollow chilled mandrel movable within the mold and bottom plate for molding the inner surface of the hollow article, a coaxial drive arm on said mandrel, drive means engaging said drive arm moving the mandrel selectively within the mold and measuring means acting on a body of molten metal in said mold determining molten metal level relative to the mandrel top and acting on the drive means moving the mandrel to maintain the mandrel top at a preselected position relative to the molten metal, said mandrel having an upper portion of generally uniform cylindrical shape of sufficient length to solidify the inner wall of metal of an ingot poured therein sufficiently to support molten metal in the interior against break out when unsupported by the mandrel and a bottom tapered frusto conical tapered at an angle sufficient to provide support to the cooling internal wall of a hollow article while following the reduction in internal diameter of said hollow ingot during cooling.

6. An apparatus as claimed in claim 5 wherein the bottom plate is provided with at least two vertical projections extending above the plate intermediate the mold and mandrel.

7. An apparatus as claimed in claim 5 wherein the measuring means is a source of radiation directed through the mold to a detector means in the mandrel.

8. An apparatus as claimed in claim 5 wherein the measuring means is a device for measuring the force required to move the mandrel and providing a signal to the drive means.

9. An apparatus as claimed in claim 5 wherein the measuring means is a dip stick adapted to contact molten metal to measure its position.

10. An apparatus as claimed in claim 5 wherein the mold is vertically movable independently of the mandrel and drive means are connected to the mold for moving the same.

11. An apparatus as claimed in claim 5 wherein the measuring means is a source of radiation directed through the mold to a detector means in the mandrel and a device for measuring the force required to move the mandrel and providing a signal to the drive means.

12. An apparatus as claimed in claim 5 including cooling means cooling the metal leaving the mold.

* * * * *

UNITED STATES PATENT AND TRADEMARK OFFICE

CERTIFICATE OF CORRECTION

PATENT NO. : 4,146,077

DATED : March 27, 1979

INVENTOR(S) : H. Joseph Klein and Wilfredo V. Venal

It is certified that error appears in the above-identified patent and that said Letters Patent are hereby corrected as shown below:

Column 1, line 38, "superallys" should read --superalloys--.

Column 3, line 12, "6 1/2" should be --6 3/4--.

Column 3, line 41, "13/4" should be --1 3/4--.

Column 3, line 47, "1.5)" should be --1.5°--.

Column 3, line 51, " 4' " should be -- 4" --.

Column 3, line 53, " 13' " should be -- 13" --.

Column 3, line 59, "70F/15/10/5" should be --70F/15/0/5--.

Signed and Sealed this

*Twenty-sixth* Day of *June 1979*

[SEAL]

*Attest:*

RUTH C. MASON
*Attesting Officer*

DONALD W. BANNER
*Commissioner of Patents and Trademarks*